United States Patent [19]

Hopkins et al.

[11] Patent Number: 4,530,606

[45] Date of Patent: Jul. 23, 1985

[54] APPARATUS FOR STIRRING SOLUTIONS IN SMALL VESSELS

[76] Inventors: Thomas R. Hopkins; Linda L. Hopkins, both of 3417 Willowood Dr., Bartlesville, Okla. 74006

[21] Appl. No.: 429,151

[22] Filed: Sep. 30, 1982

[51] Int. Cl.[3] ..... B01F 7/28

[52] U.S. Cl. ..... 366/129; 366/279; 366/343

[58] Field of Search ..... 366/129, 130, 241, 247, 366/248, 249, 251, 279, 289, 305, 342, 343, 605, 117, 118, 120, 250; 403/333, 334

[56] References Cited

U.S. PATENT DOCUMENTS

| | | | |
|---|---|---|---|
| 2,042,176 | 5/1936 | Hausman | 366/251 |
| 2,070,956 | 2/1937 | Pelton | 366/120 |
| 2,637,537 | 5/1953 | Ernst | 366/343 |
| 2,733,900 | 2/1956 | Wobensmith | 366/605 |
| 3,004,767 | 10/1961 | Greene et al. | 403/334 |
| 3,311,354 | 3/1967 | Wilson | 366/248 |

*Primary Examiner*—Robert W. Jenkins
*Assistant Examiner*—Arthur D. Dahlberg

[57] ABSTRACT

A small, light-weight stirring apparatus for stirring liquid solutions and suspension comprises a power source, a rotable or vibratory motor and an inexpensive, disposable hollow stirring shaft made of a polymeric material. The inexpensive hollow stirrer is disposed after each stirring operation, thus obviating cleaning of the stirrer.

6 Claims, 2 Drawing Figures

APPARATUS FOR STIRRING SOLUTIONS IN SMALL VESSELS

BACKGROUND OF THE INVENTION

This invention relates to a small, hand-held apparatus for agitating liquid solutions or suspensions. In accordance with another aspect, this invention relates to an electrically operated agitating apparatus. In accordance with a further aspect, this invention relates to an agitating apparatus having a disposable hollow mixing shaft made of a polymer material.

In some fields of science and commerce there has been a growing trend to conduct analytical analysis, physical mixing or stirred chemical or biochemical reactions in smaller vessels such as test-tubes, cups or cuvettes. Such vessels typically hold from 0.1 to 50 mL of liquid. This is done to conserve valuable materials and to minimize the laboratory space needed to conduct analysis, mixing or reactions. Such a trend also receives emphasis from the fact that the sample size required by many analytical instruments has become much smaller than a few decades ago. As smaller vessels are used, it has become necessary to find smaller pieces of equipment to achieve mixing in these vessels. A logical answer is to scale down manually and electrically driven mixers. Such stirrers known in the art are described in the catalogs of instrument supply companies. Despite the claim to being small or ministirrers, some are still too large to be used in small vessels such as test-tubes, sample cups cuvettes and beakers.

Furthermore, the present art does not address some unique problems encountered in using small mixing vessels holding from 0.1 to 50 mL liquid. Such vessels often have narrow necks and stirring shafts rigidly attached to motor drives are difficult to align to avoid vessel damage or spillage. Sill further, because the agitating shaft is permanently mounted to the drive motor, it is necessary to clean or wipe the drive shaft between samples when working with multiple samples. Cross-contamination can be a serious problem and it would be desirable to use a new sanitized agitator shaft for each sample. Finally, it is desirable in many stirring operations using test-tubes to disperse and resuspend a fine and sometimes sticky solid mass obtained by previous centrifugation of a solid-liquid suspension. The centrifuged solid mass rests in the bottom of a centrifuge test tube and must be mechanically loosened from the bottom and broken up with a stirring device. Using the presently available electrically driven stirrers cited above, one cannot accomplish a mechanical loosening and breakage without risk of damage to the test tube, stirring apparatus or operator.

THE INVENTION

The apparatus of this invention is an agitating apparatus comprising (a) an electrically powered drive device having a drive shaft, (b) connecting means mounted on said drive shaft, and (c) a hollow polymeric agitating (mixing) shaft attached to said drive shaft by said connecting means. The agitating apparatus is useful for mixing or stirring liquid solutions or suspensions and can also be referred to as a mixing apparatus or stirring apparatus.

The electrically powered drive device can be an alternating current (AC) electric motor having a rotable drive shaft, a direct current (DC) electric motor having a rotable drive shaft, a solenoid or an electromagnetic vibrator. The preferred drive device is a cordless DC electric motor powered by an electric battery having a voltage ranging from about 1.5 to 12 volts. The AC or DC electric motor can be actuated by an electric switch. The connecting means that connect the hollow polymeric agitating shaft to the drive shaft can be an elastic sleeve, to which is attached a slightly tapered, conical finger which slides into one end of the hollow agitating shaft to hold by friction and wall distortion of the hollow shaft. Another connecting means would be the use of a chuck to grip the agitating shaft by its external surface.

The agitating apparatus can generate rotating, reciprocating and oscillating motions of said hollow, polymeric agitating (mixing) shaft.

The hollow polymeric agitating (mixing shaft) can be made of any of the well-known natural and synthetic polymers such as polyethylene, polyallomer, polypropylene, polymethylpentene, polytetrafluoroethylene, polyfluroethylenepropylene, chlorotrifluoroethylene, polycarbonate, phenylene oxide resin, penylene sulfide resin, polystyrene styreneacrylonitrite copolymer, polyacrylic, nylon (polyamide), polyvinylchloride, acetal resin polymer, and cellulosic polysaccharide, e.g., paper. The hollow, polymeric agitating shaft can be an inexpensive, commercially available drinking straw. The distal end of the hollow agitating shaft (i.e., the end not attached to the drive shaft) can have indentations, can be flattened or, preferably, can have a plurality of slits (as shown in FIGS. 1 and 2) for enhanced agitation (mixing, stirring) effeciency.

The advantages, details, features and embodiments of this invention will become apparent to those skilled in the art from the following description of the invention, the appended claims and the drawing.

Figure 1:
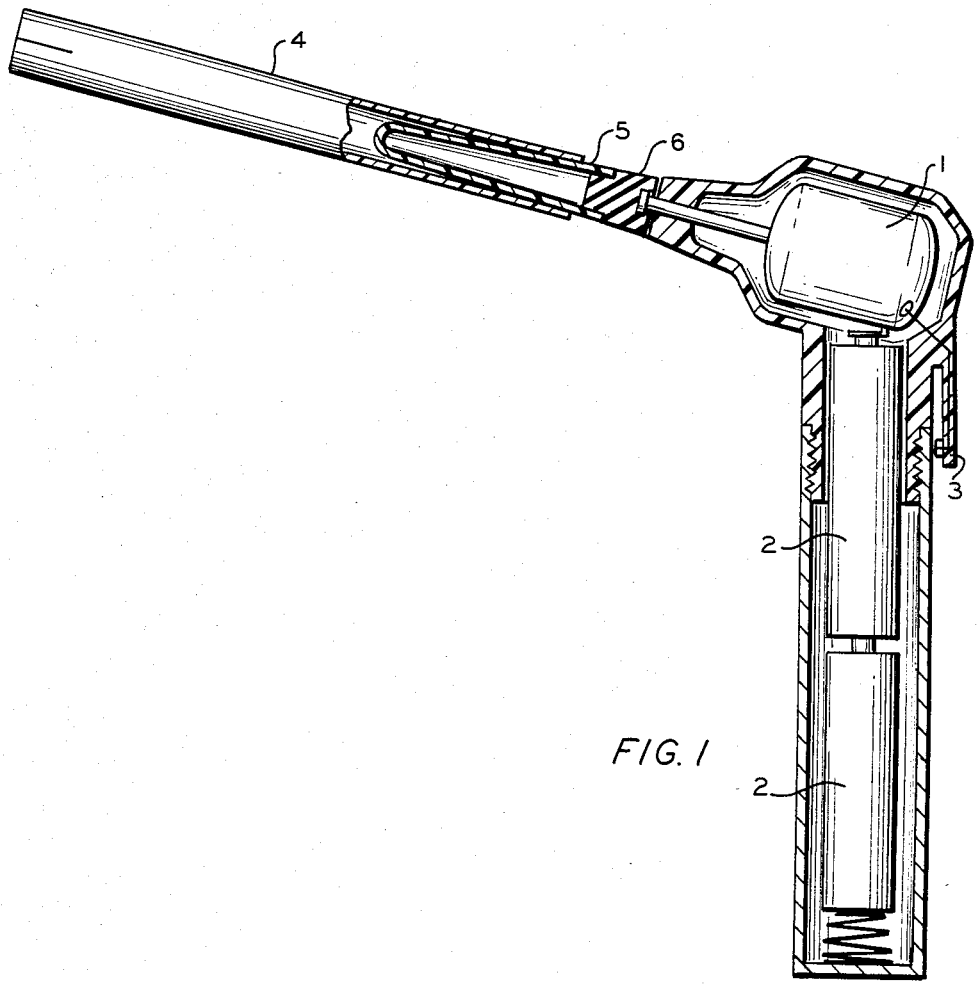
FIG. 1 illustrates an embodiment of the agitating apparatus of the present invention.
Figure 2:
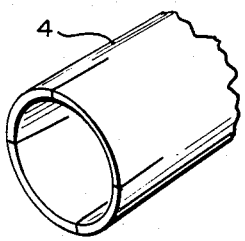
FIG. 2 shows a partial view of the hollow agitating shaft having a plurality of slits at the distal end.

A view of the essential elements of the stirring apparatus in accordance with this invention is shown in the attached FIGS. 1 and 2.

In a preferred embodiment, the apparatus of this invention is a portable agitating apparatus comprised of an electric motor (1) powered by two 1.5 V electric batteries (2) contained within the portion of the apparatus held in the hand. Also located in the motor-battery housing is an electric switch (3). The drive shaft of the motor is linked to a hollow agitating shaft (4) by a connecting means consisting of a finger-like insert having a slight conical taper (5) which can be inserted into the hollow agitating shaft and which will be held by a combination of friction and shaft wall distortion. The end of the connecting means opposite from that which holds the hollow agitating shaft is fixed to the motor drive shaft with a flexible rubber or plastic coupling (6). The coupling imparts a flexibility to the connecting means and the hollow agitating shaft which eliminates the requirement for precise alignment during operation of the stirring device within the liquid-containing vessel. The hollow agitating shaft (4), in the preferred embodiment, is made out of inexpensive polypropylene drinking straws having a length of 2 to 3 inches. The diameter of the hollow tube can vary from 1/16 inch to ⅜ inch. Operation of the above described embodiment of the stirring apparatus using thin walled hollow tubes reveals a suprising result. Unlike a solid rod of like dimensions in length and diameter, the hollow tube achieves much greater agitation of a liquid. One non-exclusive explanation for this unexpected difference is that commercial thin walled, polymeric drinking straws have non-uniform wall thickness. This, combined with the general flexibility of the thin plastic wall, leads to a distorted, ovaloid cross section in the tube during high speed rotation. The temporarily flattened, rotating hollow shaft thus is able to move much larger volumes of liquid. This distortion of the thin wall of the hollow polymeric straw can be further accentuated by cutting one or more ¼ to ½ inch longitudinal slits in the mixing end of the plastic straw. A further advantage to the present invention is that the hollow polymeric agitating shaft is made of a material which is non-abrasive, not shattered and can be reversibly distorted, thus permitting the aggressive use of the rotating tip along the inside surfaces and bottom of the liquid containing vessel to achieve good mixing and dispersal of solid material without damage to the vessel, stirring apparatus or stirring apparatus operator.

To further illustrate the instant invention, the following example is provided.

EXAMPLE

A thirty mL beaker was filled with 25 mL of water. Using the preferred embodiment of the mixing apparatus illustrated in FIG. 1, a polypropylene drinking straw, having a length of 4 inches and a diameter of ¼ inch, was attached. Vigorous mixing was observed with air entrainment and vortexing during operation of the apparatus. Next, a stiff plastic, round rod having the same dimensions as the polypropylene drinking straw was attached to the apparatus. In this case, mixing of the water contained in the 30 mL beaker was much poorer.

This example illustrates the unexpected improved stirring action of a thin-walled, hollow polymeric stirring shaft compared to that of a solid rod of like dimensions.

We claim:

1. A stirring apparatus comprising:
(a) an electrically powered drive device having a rotable drive shaft;
(b) connecting means fixedly mounted on said drive shaft; and
(c) a hollow, polymeric, tubular agitating shaft being fixedly attached at one end to said drive shaft by said connecting means, said agitating shaft being open at the end not attached to said drive shaft.

2. A stirring apparatus according to claim 1, wherein said electrically powered drive device is an electric motor; the connecting means has two opposite ends and has the shape of a slightly tapered, conical finger; the agitating shaft has two open ends; the first end of said connecting means having the larger diameter is fixed to said drive shaft with a coupling; and the other end of said connecting means is inserted into one open end of said agitating shaft so as to fixedly hold said agitating shaft by friction and wall distortion.

3. A stirring apparatus according to claim 2 wherein said electric motor is powered by an electric battery.

4. A stirring apparatus according to claims 1, 2, or 3 wherein said agitating shaft is made of at least one material selected from the group consisting of polyethylene, polyallomer, polypropylylene, polymethylpentene, polytetrafluoroethylene, polyfluoroethylenepropylene, chlorotrifluoroethylene, polycarbonate, phenylene oxide resin, phenylene sulfide resin, polystyrene, styreneacrylonitrite copolymer, polyacrylic, nylon (polyamide), polyvinychloride, acetal resin polymer and cellulosic polysaccharide.

5. A stirring apparatus according to claim 4 wherein said agitating shaft has a plurality of slits at the distal end that is not attached to said drive shaft.

6. A stirring apparatus according to claim 2 wherein said electric motor is actuated by a switch.

* * * * *